US009134693B2

(12) United States Patent
Kawamura et al.

(10) Patent No.: US 9,134,693 B2
(45) Date of Patent: Sep. 15, 2015

(54) IMAGE FORMING APPARATUS WITH DEVELOPING UNIT AND CONTROL METHOD THEREFOR

(71) Applicant: CANON KABUSHIKI KAISHA, Tokyo (JP)

(72) Inventors: Hiroshi Kawamura, Suntou-gun (JP); Kei Sawanaka, Susono-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/102,704

(22) Filed: Dec. 11, 2013

(65) Prior Publication Data

US 2014/0169833 A1 Jun. 19, 2014

(30) Foreign Application Priority Data

Dec. 13, 2012 (JP) ..... 2012-272621
Dec. 4, 2013 (JP) ..... 2013-251040

(51) Int. Cl.
*G03G 15/01* (2006.01)
*G03G 21/18* (2006.01)

(52) U.S. Cl.
CPC .... *G03G 21/1825* (2013.01); *G03G 2215/0132* (2013.01)

(58) Field of Classification Search
CPC ..... G03G 15/0813
USPC ..... 399/228
See application file for complete search history.

(56) References Cited

U.S. PATENT DOCUMENTS

2007/0048022 A1* 3/2007 Inaba ..... 399/228

FOREIGN PATENT DOCUMENTS

JP 4667106 B2 10/2006
JP 2007-058073 A 3/2007
JP 2012-022142 A 2/2012

* cited by examiner

*Primary Examiner* — Walter L Lindsay, Jr.
*Assistant Examiner* — Milton Gonzalez
(74) *Attorney, Agent, or Firm* — Canon U.S.A. Inc., IP Division

(57) ABSTRACT

First and second developing members are moved to a developing position from a retracted position respectively in the order of a first developing member and a second developing member, and image forming is started by adhering toner to a first photosensitive member and a second photosensitive member in this order, and a period in which the first developing member moves from the retracted position to the developing position is shorter than a period in which the second developing member moves from the retracted position to the developing position.

10 Claims, 11 Drawing Sheets

IMAGE FORMING APPARATUS WITH DEVELOPING UNIT AND CONTROL METHOD THEREFOR

BACKGROUND OF THE INVENTION

1. Field of the Invention

This disclosure relates to an image forming apparatuses such as copying machines, printers, facsimile machines, and multifunction peripherals configured to form images on the basis of an electrophotographic image forming system or an electrostatic recording method.

2. Description of the Related Art

Examples of the image forming apparatuses of the electrophotographic image forming system include an in-line type image forming apparatus having a plurality of photosensitive members and process units (charging units, developing units, and cleaning units) operated in conjunction with the photosensitive members, and a belt configured to come into contact with the photosensitive members, and configured to be capable of forming color images on a transfer material.

There is also an image forming apparatus employing a contact developing method which performs developing in a state in which developing rollers are in contact with a photosensitive members. When employing the contact developing method, phenomena such as shortening of the lifetime caused by wearing of a surface layer of the photosensitive member due to sliding contact with the developing roller, waste of developer and contamination of the transfer material caused by the developer (toner) adhered to the photosensitive member at the time other than image formation, and deformation of the developing roller by being kept in a stopped state in contact for a long time may occur.

In Japanese Patent No. 4667106, a configuration in which an occurrence of the above-described phenomena is suppressed when the contact developing method is employed in the in-line type image forming apparatus is proposed. Specifically, the developing roller is configured to be movable between an contact position in contact with the photosensitive member and a separated position separated from the photosensitive member, the developing roller is arranged at the contact position with respect to the photosensitive member only during a period in which the electrostatic latent image on the photosensitive member is developed, and is arranged at the separated position during other periods.

When performing color image formation with the in-line configuration, the image formation is started on the respective photosensitive members in sequence with time lags in conformity with a rotation of a belt so that toner images transferred from the respective photosensitive members are overlapped one on top of another on the belt of on a transfer material conveyed by the belt. In contrast, in Japanese Patent No. 4667106, the plurality of developing rollers are configured to come into contact with corresponding photosensitive members with time lag in sequence so as to keep the developing rollers separated from the photosensitive member as long as possible until immediately before starting development.

Here, the developing rollers each need to be moved slowly from the separated position to the contact position in a predetermined period so as to avoid a distortion of images due to shaking of the apparatus caused by an impact caused by the developing roller coming into contact with the photosensitive drums.

On the other hand, in order to improve the usability, shortening of a time period from an input of a print signal to the image forming apparatus until an output of a first transfer material with a toner image formed thereon (FPOT=First Print Out Time) is required in recent years. One of conceivable methods to reduce the FPOT is shortening the time period from the input of the print signal to the image forming apparatus until the start of development for the first time. Therefore, a method of shortening the FPOT by shortening the time period required for the developing roller which starts development firstly to move to a contact position is conceivable.

However, in Japanese Patent No. 4667106, the time periods required for moving the respective developing rollers from the separated positions to the contact positions are set to be all the same. Therefore, when the time period required for moving each of the developing rollers from the separated position to the contact position is set to suppress the impact occurring when the developing roller comes into contact with the photosensitive drum, a time period required for the developing roller which firstly starts the development to move from the separated position to the contact position may become an obstacle for shortening the FPOT.

In other words, in the configuration disclosed in Japanese Patent No. 4667106, when an attempt is made to shorten the time period required for the developing roller which firstly starts the development to move from the separated position to the contact position in order to shorter the FPOT, the time periods required for other developing rollers to move from the separated positions to the contact positions are also shortened, so that the image may be distorted due to the impact occurring when other developing rollers come into contact with the photosensitive drums.

SUMMARY OF THE INVENTION

The invention provides an image forming apparatus which allows shortening of an FPOT while suppressing a distortion of images. The invention also provides an image forming apparatus configured as described below.

There is provided an image forming apparatus including: first and second photosensitive members; and first and second developing members provided corresponding to the first and second photosensitive members and configured to be movable between developing position where toner is adhered to the corresponding photosensitive members and retracted position retracted from the developing position respectively; wherein the first and second developing members are moved to the developing position from the retracted position respectively in the order of the first developing member and the second developing member, and image forming is started by adhering the toner to the first photosensitive member and the second photosensitive member in this order, and wherein the period in which the first developing member moves from the retracted position to the developing position is shorter than a period in which the second developing member moves from the retracted position to the developing position.

Further features of the present invention will become apparent from the following description of exemplary embodiments with reference to the attached drawings.

DESCRIPTION OF THE EMBODIMENTS

EXAMPLE 1

Referring not to the drawings, examples of this disclosure will be described.

General Configuration of Image Forming Apparatus

Figure 1:
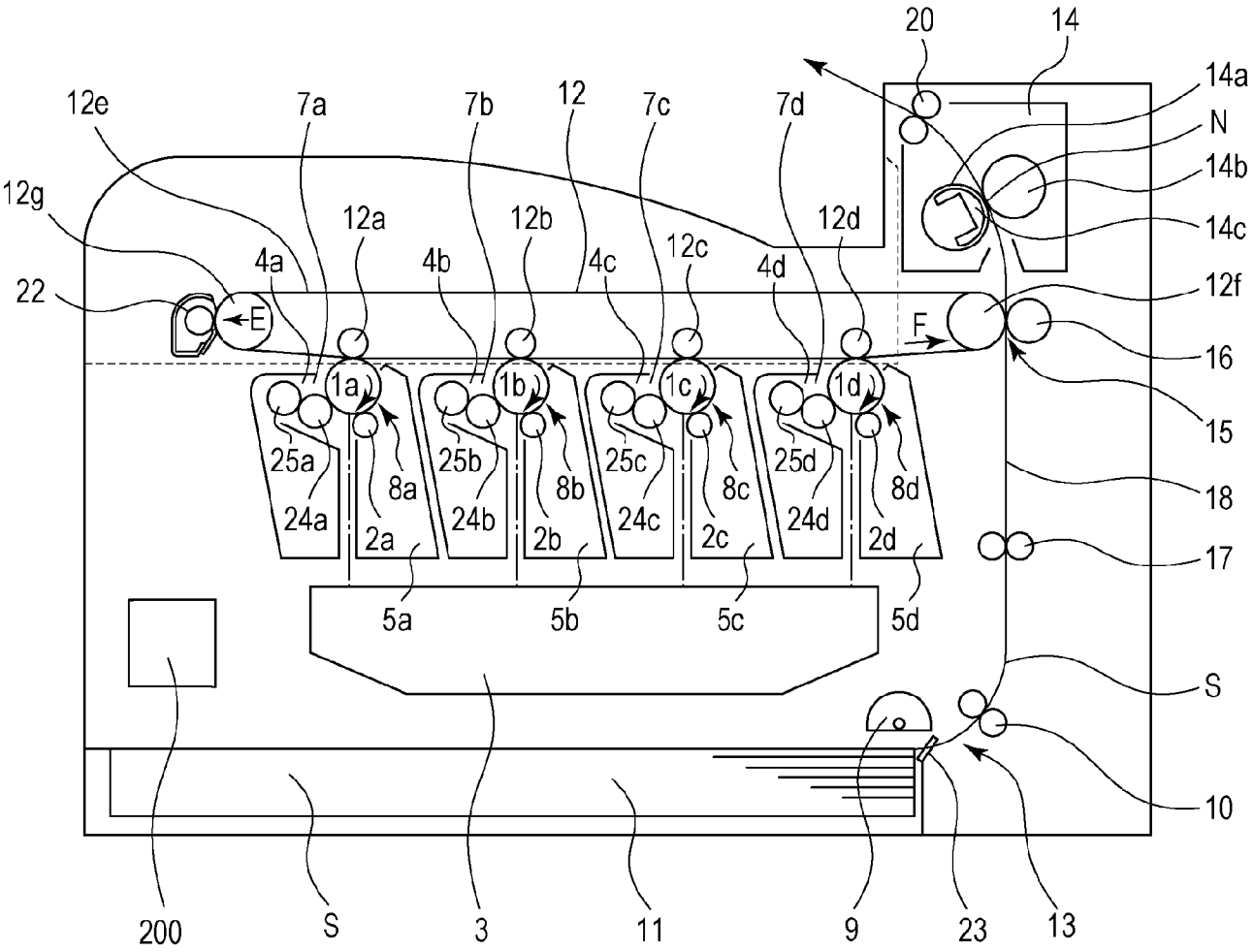
FIG. 1 is a schematic cross sectional view of an image forming apparatus.

FIG. 1 is a schematic cross sectional view of an image forming apparatus (printer 100). A cassette 11 is stored in a lower portion of the printer 100 so as to be drawable. A transfer material S is stored in the cassette 11 in a stacked manner, is separated into pieces, and is fed. The printer 100 includes process cartridges 7*a*, 7*b*, 7*c*, and 7*d* (these four members may be collectively referred to as a process cartridge 7 hereinafter) corresponding respectively to Yellow (Y), Magenta (M), Cyan (C), and Black (K) as image forming sections arranged in parallel. The process cartridges 7*a*, 7*b*, 7*c*, and 7*d* includes photosensitive drums 1*a*, 1*b*, 1*c*, and 1*d* (these four members may be collectively referred to as a photosensitive drum 1 hereinafter) as image bearing member, charging units 2*a*, 2*b*, 2*c*, and 2*d* configured to negatively charge the surfaces of the photosensitive drums 1*a*, 1*b*, 1*c*, and 1*d* uniformly, developing units 4*a*, 4*b*, 4*c*, and 4*d* (these four members may be collectively referred to as a developing unit 4 hereinafter) configured to develop toner images by causing toner to be adhered to electrostatic latent images, cleaning blades 8*a*, 8*b*, 8*c*, and 8*d* configured to remove toner remaining on the photosensitive drums 1*a*, 1*b*, 1*c*, and 1*d*, and cleaner units 5*a*, 5*b*, 5*c*, and 5*d* having toner containers for storing toners of respective colors, respectively. The developing units 4*a*, 4*b*, 4*c*, and 4*d* support developing rollers 24*a*, 24*b*, 24*c*, and 24*d* (these four members may be collectively referred to as a developing roller 24 hereinafter) and supply rollers 25*a*, 25*b*, 25*c*, and 25*d* so as to be rotatable, respectively. The developing roller 24 is configured to be capable of coming into contact with and separating from the photosensitive drum 1 (movable between the contact position and the separated position). In this configuration, the developing roller 24 is brought into contact with the photosensitive drum 1 at a timing when toner is adhered to the electrostatic latent image formed on the photosensitive drum 1 and developed, and the developing roller 24 is kept apart from the photosensitive drum 1 during other period so as to improve the lifetime of the developing roller 24 or the photosensitive drum 1. A scanner unit 3 configured to irradiate the photosensitive drum 1 with a laser beam and form a latent image on the photosensitive drum 1 on the basis of image information is provided below the process cartridge 7 and an intermediate transfer unit 12 is provided above the process cartridge 7.

The intermediate transfer unit 12 includes primary transfer rollers 12*a*, 12*b*, 12*c*, and 12*d*, an intermediate transfer belt 12*e* in an endless cylindrical shape, a drive roller 12*f*, a tension roller 12*g*, and a cleaning device 22 configured to remove toner on the intermediate transfer belt 12*e*. The cleaning device 22 is arranged upstream of the primary transfer portion 12*a* composed of the first photosensitive drum 1*a* and the primary transfer roller 12*a* and downstream of a secondary transfer portion 15 composed of the drive roller 12*f* and a secondary transfer roller 16. Furthermore, the cleaning device 22 is positioned and held by a shaft of the tension roller 12*g*. Therefore, the cleaning device 22 is configured to follow positional variations of the tension roller 12*g*. Since the intermediate transfer belt 12*e* and the cleaning device 22 are consumable goods, the intermediate transfer unit 12 integrated with the cleaning device 22 is demountably mountable on a main body of the image forming apparatus. The toner remaining on the intermediate transfer belt 12*e* collected by the cleaning device 22 is accumulated in a toner collecting container (not illustrated) arranged in the printer 100.

The drive roller 12*f* is rotated by a drive source such as a motor (not illustrated), whereby the intermediate transfer belt 12*e* rotates at a predetermined speed in a direction indicated by an arrow F in FIG. 1. In a process of primary transfer, toner is transferred onto the intermediate transfer belt 12*e* by applying a positive bias voltage to the primary transfer rollers 12*a*, 12*b*, 12*c*, and 12*d*, and using a potential difference with respect to the negatively charged surface of the photosensitive drums 1*a*, 1*b*, 1*c*, and 1*d*. Toner images on the photosensitive drums 1*a*, 1*b*, 1*c*, and 1*d* are primarily transferred to the intermediate transfer belt 12*e* one on top of another at primary transfer portions formed between the primary transfer rollers 12*a*, 12*b*, 12*c*, and 12*d* and the photosensitive drums 1*a*, 1*b*, 1*c*, and 1*d*, respectively. The toner images transferred on the intermediate transfer belt 12*e* are transferred to the transfer material S at the secondary transfer portion 15 formed between the drive roller 12*f* and the secondary transfer roller 16. Subsequently, the transfer material S passes through the fixing unit 14, where fixation of the transferred images, conveyed to the discharge roller pair 20 and is output to a transfer material stacking portion.

The feeding unit 13, here, includes a paper feed roller 9 configured to feed the transfer material S from the sheet supplying cassette 11 in which the transfer material S is stored, and a conveying roller pair 10 configured to convey the transfer material S. The transfer material S stored in the sheet supplying cassette 11 is subjected to pressure contact by the paper feed roller 9, is separated into pieces by a separation pad 23 (frictional strip separating system), and is conveyed.

The transfer material S conveyed from the feeding unit 13 is conveyed in turn to the secondary transfer portion 15 by the registration roller pair 17.

The fixing unit 14 is configured to apply heat and pressure on an image formed on the transfer material S and fix the image. Reference numeral 14*a* denotes a cylindrical fixing belt and is guided by a belt guide member 14*c* having a heat generating device such as a heater adhered thereto. Reference numeral 14*b* denotes an elastic press roller, which forms a fixing nip N having a predetermined width with a predetermined pressure contact force in cooperation the belt guide member 14*c* with the fixing belt 14*a* interposed therebetween.

The printer 100 includes a control unit 200 configured to control an image forming operation performed by the printer 100.

Control Unit

Figure 2:
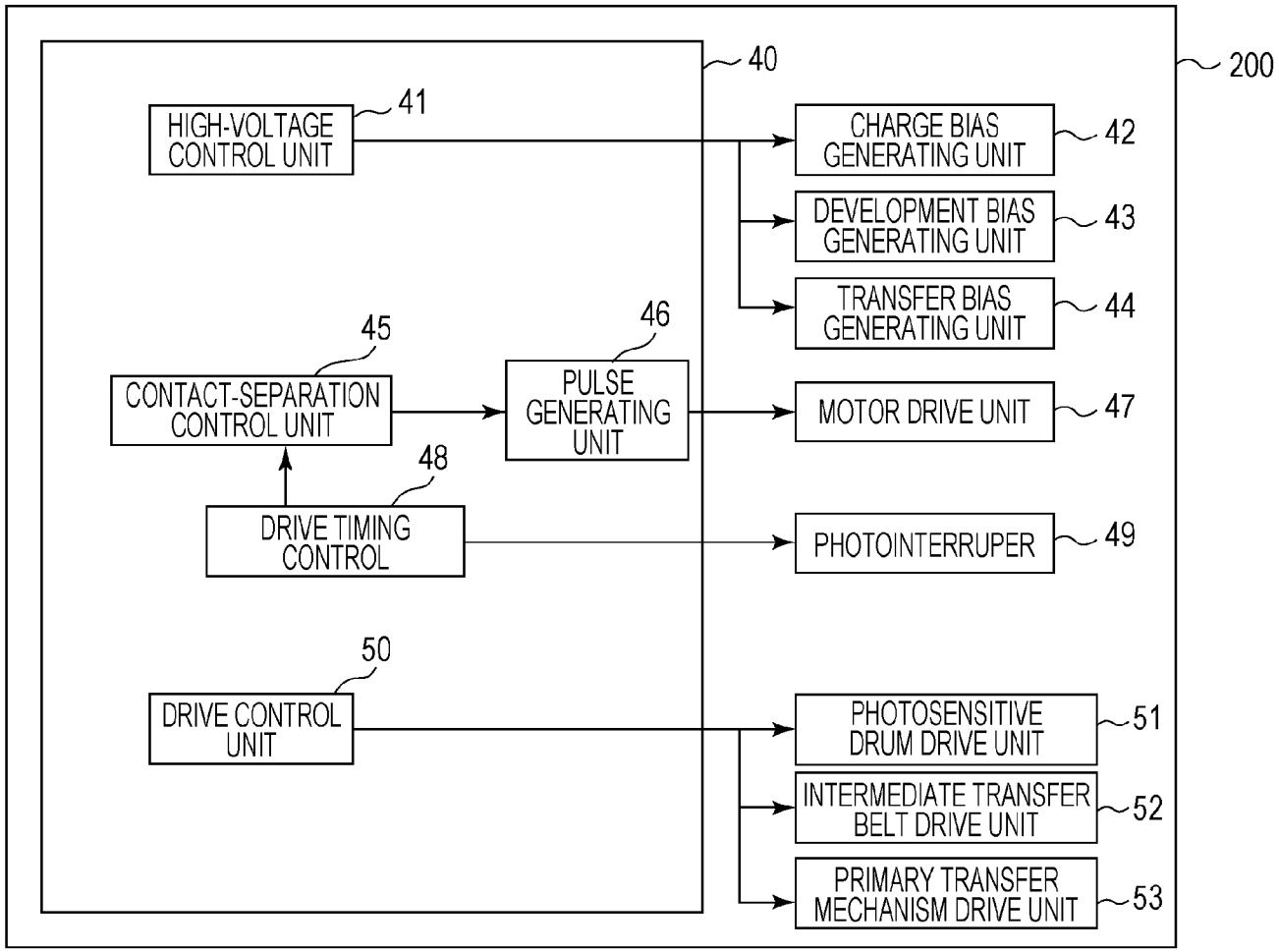
FIG. 2 is a block diagram illustrating a configuration of a control unit of the image forming apparatus.

Subsequently, a control unit 200 will be described. FIG. 2 is a block diagram illustrating a configuration of the control unit 200 of the image forming apparatus.

The printer 100 includes the control unit 200 on which an electric circuit for controlling the apparatus is mounted, and the control unit 200 includes a CPU 40 mounted thereon. The CPU 40 includes a drive control unit 50 configured to perform conveyance of the transfer material S and control of the drive source such as the process cartridge 7, a high voltage control unit 41 configured to perform control relating to image formation, and an contact-separating control unit 45 or the like configured to control contact and separation of the developing roller 24, and control the operation of the image forming apparatus collectively.

The drive control unit 50 controls a photosensitive drum drive unit 51, an intermediate transfer belt drive unit 52, and a primary transfer mechanism drive unit 53 as drive control at the time of the image formation. The high voltage control unit 41 controls a charging bias generating unit 42, a developing bias generating unit 43, and a transfer bias generating unit 44 configured to generate voltage required for the image formation.

The control unit 200 includes a motor drive IC 47 configured to control driving of a contact-separation motor (see FIG. 3A) of a contact-separation mechanism of developing roller described later. Then, switching of excitation of the contact-separation motor 90 is performed by the CPU 40 by sending a pulse signal (in Example 1, 2-phase excitation is employed as an excitation system) to the motor drive IC 47. The motor drive IC 47 receiving the pulse signal controls the direction of electric current flowing through a coil of the contact-separation motor 90 corresponding to the pulse signal and is configured, at that time, to reverse a field magnetic pole in the contact-separation motor 90 to rotate a rotor magnet. The rotation speed of the contact-separation motor 90 depends on a frequency (hereinafter, defined as a drive frequency) of a pulse signal sent from the CPU 40, and the higher the drive frequency becomes, the shorter the reverse cycle of the field pole in the contact-separation motor 90 becomes, and the rotation speed of the contact-separation motor 90 is also increased.

Figure 3A:
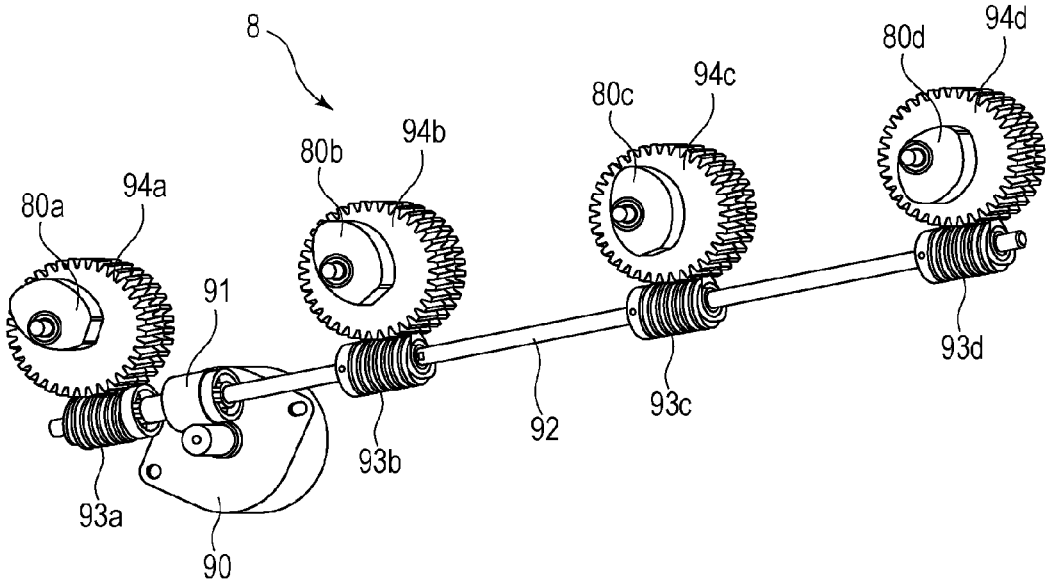
FIG. 3A is a perspective view of a contact-separation mechanism of developing roller.
Figure 3B:
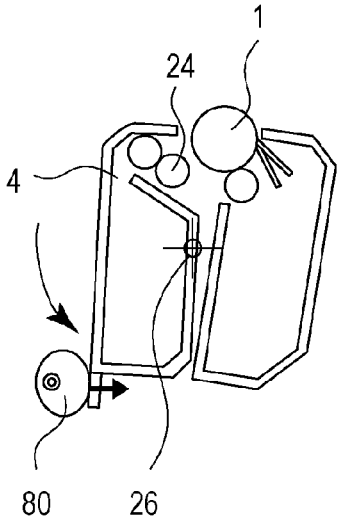
FIG. 3B is a schematic cross-sectional view illustrating part of the contact-separation mechanism of developing roller at the time of separation of developing roller.
Figure 3C:
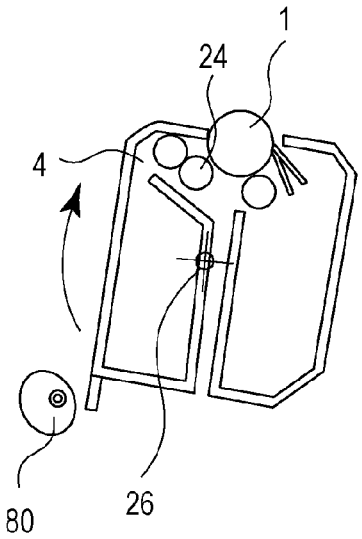
FIG. 3C is a schematic cross-sectional view of part illustrating the contact-separation mechanism of developing roller at the time of contact of development roller.

The contact-separating control unit 45 configured to control timing or the like of the contact and separation controls the pulse generating unit 46 for driving the contact-separation motor 90, and the pulse signal generated by the pulse generating unit 46 is sent to the motor drive unit (motor drive IC) 47. A signal of the photointerrupter 49, which is a position detecting sensor, described later, is sent to the drive timing control unit 48, and is used for controlling the contact and the separation. Contact-separation mechanism of developing roller Subsequently a contact-separation mechanism of developing roller will be described. First of all, with reference to FIGS. 3A to 3C, a mechanism for switching between the contact and the separation of the developing roller 24 with respect to the photosensitive drum 1 will be described. FIG. 3A is a perspective view of the contact-separation mechanism of developing roller. FIG. 3B is a schematic cross-sectional view illustrating part of the contact-separation mechanism of developing roller at the time of separation of developing roller. FIG. 3B is a schematic cross-sectional view of part of the contact-separation mechanism of developing roller at the time of separation of developing roller, and FIG. 3C is a schematic cross-sectional view illustrating part of the contact-separation mechanism of developing roller at the time of contact of developing roller. The contact-separation motor 90, which is a drive source for switching the position (contact position, separated position) of the developing roller 24 with respect to the photosensitive drum 1 is a stepping motor, is connected to a drive switching shaft 92 via the pinion gear 91. Worm gears 93*a*, 93*b*, 93*c*, and 93*d* for driving cam gears 94*a*, 94*b*, 94*c*, and 94*d*, respectively, are provided on the drive switching shaft 92, and configured to rotate the cam gears 94*a*, 94*b*, 94*c*, and 94*d* and change rotational phases of the four cams 80*a*, 80*b*, 80*c*, and 80*d* by rotating the drive switching shaft 92 by the rotation of the contact-separation motor 90. The cam 80 is capable of restricting the position of the developing unit 4 and the developing roller 24 by coming into contact with the developing unit 4 of the process cartridge 7, and is configured to switch between the contact and the separation of the photosensitive drum 1 with respect to the developing roller 24 by pressing or releasing the pressing force on the side surface of the developing unit 4.

In this manner, the drive switching shaft 92 as a moving member configured to translate the developing rollers 24*a*, 24*b*, 24*c*, and 24*d* with respect to the photosensitive drums 1*a*, 1*b*, 1*c*, and 1*d* and four cams 80*a*, 80*b*, 80*c*, and 80*d* are rotated by the single contact-separation motor 90 so that the positions of the developing rollers 24*a*, 24*b*, 24*c*, and 24*d* with respect to the photosensitive drums 1*a*, 1*b*, 1*c*, and 1*d* (contact position, separated position) can be changed.

As illustrated in FIGS. 3B and 3C, the developing unit 4 rotatably supports the developing roller 24, and concurrently, is rotatable about the pivotal center 26, and is urged by an urging device, not illustrated. Therefore, when the developing unit 4 is pressed by the cam 80 and the developing roller 24 rotates counterclockwise against an urging force of the urging device, not illustrated, the developing roller 24 moves away from the photosensitive drum 1 as illustrated in FIG. 3B. The separated position to which the developing roller 24 moves away from the photosensitive drum 1 is a retracted position where the developing roller 24 is retracted farther from the photosensitive drum 1 than the developing position. In contrast, as illustrated in FIG. 3C when the cam 80 is retracted and hence the pressing force is released, the developing unit 4 rotates clockwise by the urging force of the urging device, not illustrated, so that the developing roller 24 comes into contact with the photosensitive drum 1. The contact position where the developing roller 24 is in contact with the photosensitive drum 1 corresponds to a developing position at which toner is adhered to the electrostatic latent image on the photosensitive drum 1 to achieve formation of the toner image. The developing position of Example 2 corresponds to a position where the developing roller 24 comes into contact with the photosensitive drum 1. However, as described above, the developing roller 24 does not necessarily have to be in contact with the photosensitive drum 1 as long as it is the position for causing the toner to be adhered to the electrostatic latent image on the photosensitive drum 1 to form a toner image.

In Example 1, the developing roller 24 is moved by rotating a moving member for translating the developing roller 24 including the cam 80 and the shaft 92 by the contact-separation motor 90 as a drive source. However, the example disclosed here in not limited thereto. In other words, if it is configured to move the plurality of rollers 24*a*, 24*b*, 24*c*, and 24*d* by activating the moving member by a single actuator, the operation of the moving member or the actuator does not have to be rotation.

Figure 4A:
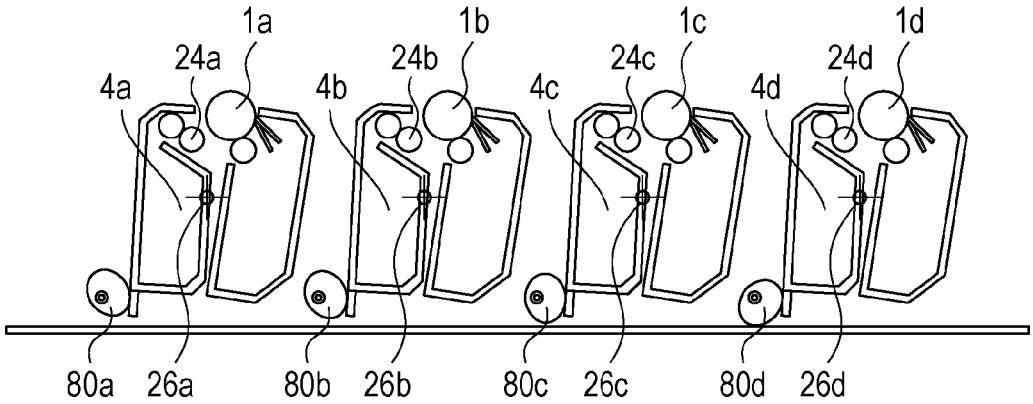
FIG. 4A is a schematic cross-sectional view illustrating the contact-separation mechanism of developing roller in a state in which all of the developing rollers are in a separated state.
Figure 4B:
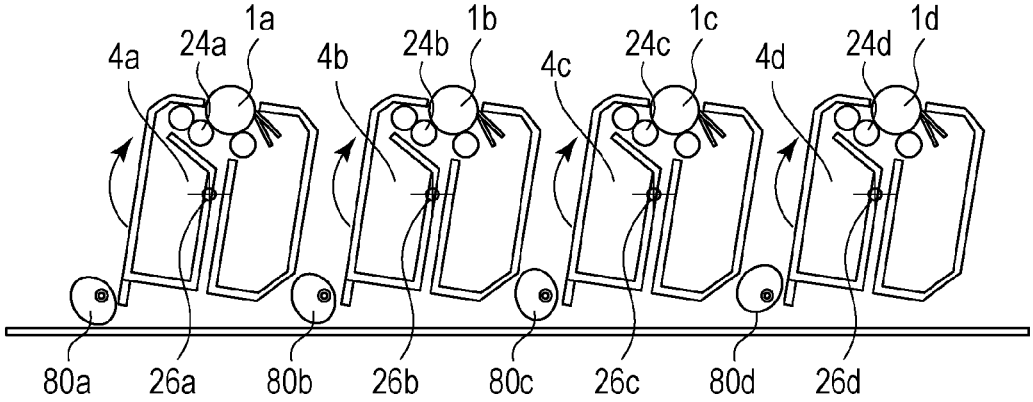
FIG. 4B is a schematic cross-sectional view illustrating the contact-separation mechanism of developing roller in a color printing state.
Figure 4C:
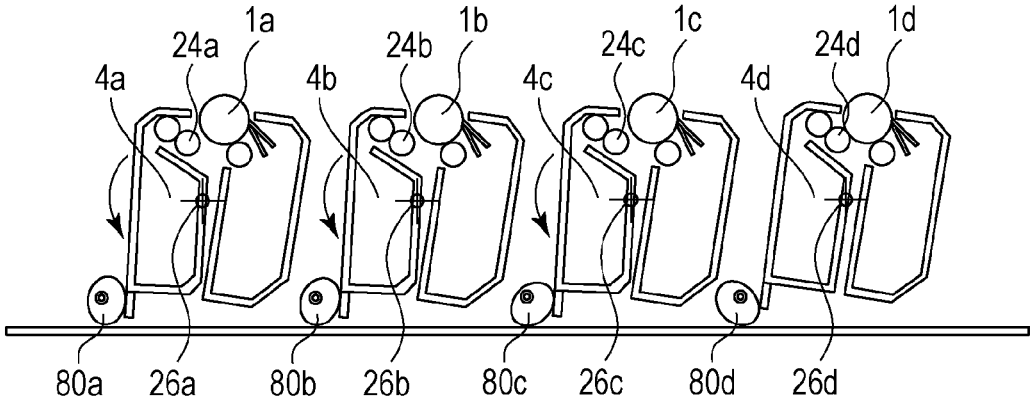
FIG. 4C is a schematic cross-sectional view illustrating the contact-separation mechanism of developing roller in a monochrome printing state.

FIGS. 4A to 4C are schematic cross-sectional views for explaining the contact and the separation of the developing rollers 24*a* to 24*d* achieved by the four cams 80*a* to 80*d* of the contact-separation mechanism of developing roller. FIG. 4A illustrates an all separated state, FIG. 4B illustrates a color printing state, and FIG. 4C illustrates a monochrome printing state.

The four cams 80*a*, 80*b*, 80*c*, and 80*d* have all the same shape and, as illustrated later, are arranged at different rotational phases. In the all separated state, as illustrated in FIG. 4A, the cams 80*a* to 80*d* press side surfaces of the developing units 4*a* to 4*d*, and the photosensitive drum 1*a* to 1*d* corresponding to all the developing rollers 24*a* to 24*d* are separated from each other, which is a waiting state. In the color printing state, as illustrated in FIG. 4B, all the cams 80*a* to 80*d* release the pressing force on the side surfaces of the developing units 4*a* to 4*d*, and the photosensitive drum 1*a* to 1*d*corresponding to all the developing rollers 24*a* to 24*d* are in the state of being capable of coming into contact with each other. In the monochrome printing state, as illustrated in FIG. 4C, the cams 80*a*, 80*b*, and 80*c* corresponding to three colors, yellow, magenta, and cyan press the side surfaces of the developing units 4*a*, 4*b*, and 4*c* of three colors, yellow, magenta, and cyan. Therefore, the developing rollers 24*a*, 24*b*, and 24*c* corresponding to yellow, magenta, and cyan and the photosensitive drums 1*a*, 1*b*, and 1*c* corresponding to the developing rollers 24*a*, 24*b*, and 24*c* are separated from each other. In contrast, only pressing of the side surface of the developing unit 4*d* by the cam 80*d* corresponding to black is released, and only the developing roller 24*d* corresponding to black is in contact with the photosensitive drum 1*d*.

Rotated Phase Control of Cam 80

Figure 6A:
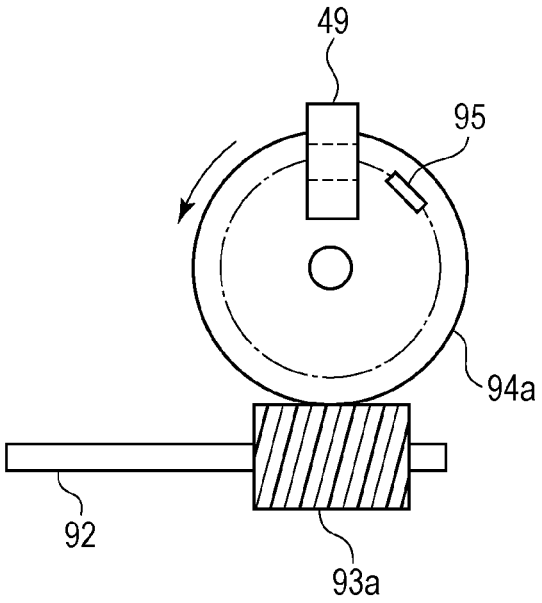
FIG. 6A illustrates a cam gear viewed from a direction of an axis of rotation thereof.
Figure 6B:
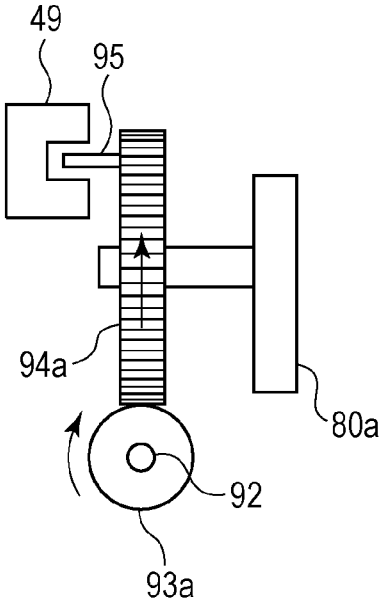
FIG. 6B illustrates the cam gear viewed from the direction of an axis of rotation of a drive switching shaft.

In this manner, switching among the waiting state, the color printing state, and the monochrome printing state is achieved by rotating the contact-separation motor 90 to rotate the four cams 80*a*, 80*b*, 80*c*, and 80*d* respectively, and controlling the rotated phases thereof. In this case, the contact-separation motor 90 needs to be stopped at a desired position. However, control of the amount of rotation of the contact-separation motor 90 is performed as described below. FIG. 6A is a drawing viewing the cam gear 94*a* from the direction of an axis of rotation, and FIG. 6B is a drawing viewing the cam gear 94*a* from the direction of axis of rotation of the drive switching shaft 92.

A rib 95 is provided on the cam gear 94*a* configured to rotate integrally with the cam 80*a* which comes into contact with the developing unit 4*a* for yellow. The rib 95 rotates by the rotation of the cam gear 94*a*, so that the cam gear 94*a* and the cam 80*a* blocks light of the photointerrupter 49 at a predetermined rotated phase. Therefore, the rotated phase of the cam 80*a* rotating together with the cam gear 94*a* may be detected on the basis of the output signal from the photointerrupter 49. Then, the position where the light in the photointerrupter 49 is blocked is determined as a reference position, and the number of driving steps of the contact-separation motor 90, which is a stepping motor, is correlated to the rotated phase of the cam 80 from the reference position. Accordingly, the rotated phase (amount of rotation) is known by counting the number of drive steps, and the contact-separation motor 90 is stopped in the waiting state, the color-printing state, and the monochrome printing sate described above. The cam gear 94 and the cam 80 are attached coaxially by the drive switching shaft 92. In Example 2, the rib 95 is provided on the cam gear 94*a* for yellow, this disclosure is not limited thereto, and may be provided on other cam gears 94*b*, 94*c*, 94*d* for magenta, cyan, and black.

In Example 1, although detection of the rotated phase of the cam gear 94 is performed by the photointerrupter 49 and the rib 95, detection may be performed by a rotary encoder or other known methods. Although the stepping motor is used as the contact-separation motor 90, this disclosure is not limited thereto. In other words, a DC brush motor, a DC brushless motor, or the like may be used as long as the cam 80 can be stopped at a predetermined rotated phase (the waiting state, the color printing state, and the monochrome printing state).

Translation to Color Printing State

Subsequently, translation from the waiting state in FIG. 4A to the contact state (color printing state) at the time of color printing state illustrated in FIG. 4B will be described. The switching of the state is performed in time to start the formation of a toner image on the photosensitive drum 1.

As described above, the four cams 80*a* to 80*d* have cam surfaces having the same shape. Then, in FIGS. 4A to 4C, the rotated phases of the cam 80*b*, the cam 80*c*, and the cam 80*d* as second cam members are shifted clockwise with reference to the cam 80*a* as a first cam member, and the amount of shift of the rotated phase is increased in the order of the cam 80*b*, the 80*c*, and the cam 80*d*. The cam surfaces of the first cam member (the cam 80*b*) and the second cam member (the cams 80*b* to 80*d*) correspond respectively to a first cam surface and a second cam surface.

In the waiting state in FIG. 4A, when the contact-separation motor 90 is rotated forward by a predetermined number of steps, the cam gears 94*a*, 94*b*, 94*c*, and 94*d* and the cams 80*a*, 80*b*, 80*c*, and 80*d* rotate counterclockwise (forward), respectively. At this time, the cam 80*a* firstly releases the pressing force on the side surface of the developing unit 4*a* due to the phase shift between the cams 80*a*, 80*b*, 80*c*, and 80*d*, and subsequently, the pressing forces on the developing units 4*b*, 4*c*, and 4*d* are released in the order of the cams 80*b*, 80*c*, and 80*d* in accordance with the shift of the rotated phase described above. In other words, when the contact-separation motor 90 is rotated forward from the waiting state in FIG. 4A, the developing rollers 24*a*, 24*b*, 24*c*, and 24*d* comes into contact with the photosensitive drums 1*a*, 1*b*, 1*c*, and 1*d* in the order of yellow->magenta->cyan->and black. Then, the image formation is started in sequence from an image-forming station at which the contact of the developing roller 24 is completed onward to form toner images on the photosensitive drums 1*a*, 1*b*, 1*c*, and 1*d* as needed, and the formed toner images are transferred to the intermediate transfer belt 12*e*. When the forward rotation of the contact-separation motor 90 by a predetermined number of steps are terminated and the contact of all of the developing rollers 24*a*, 24*b*, 24*c*, and 24*d* is completed, transfer to the contact state at the time of color printing illustrated in FIG. 4B is completed. The developing roller 24*a*, which moves to the contact position first, is defined as a first developing member, and other developing rollers 24*b* to 24*d* are defined as second developing members. In the same manner, the photosensitive drum 1*a* which starts the image formation firstly is defined as a first photosensitive member, and other photosensitive drums 1*b* to 1*d* are defined as second photosensitive members.

The reason why timings of the start of contact and the complete of the developing rollers 24*a*, 24*b*, 24*c*, and 24*d* are shifted in sequence at intervals will be described. It is because the developing rollers 24*a*, 24*b*, 24*c*, and 24*d* needs to be kept separated as long as possible until immediately before starting the image formation while starting the image formation synchronously with the timing when the toner images formed on the photosensitive drums 1*a*, 1*b*, 1*c*, and 1*d* in the image-forming stations are transferred to the intermediate transfer belt 12*e*. In other words, the timings of starting and completion of the contact of the respective developing rollers 24*a*, 24*b*, 24*c*, and 24*d* are shifted by a period equivalent to a time period required for a predetermined point on the surface of the intermediate transfer belt 12*e* tube moved from one primary transfer position coming into contact with the photosensitive drum 1 to a next primary transfer position coming into contact with the next primary transfer position of the next photosensitive drum 1, which corresponds to the distance between the primary transfer positions between the adjacent photosensitive drums 1.

The translation from the color printing state to the waiting state is performed at a timing when the formation of the toner image is terminated, and the contact-separation motor 90 is rotated forward additionally by predetermined number of steps. Accordingly, the developing rollers 24*a*, 24*b*, 24*c*, and 24*d* are separated from the photosensitive drums 1*a*, 1*b*, 1*c*, and 1*d* in sequence from the image-forming station which terminates the image formation. In other words, the developing rollers 24*a*, 24*b*, 24*c*, and 24*d* is separated (retracted) from the photosensitive drums 1*a*, 1*b*, 1*c*, and 1*d* in the order of yellow->magenta->cyan->black.

Translation to Monochrome Printing State

Subsequently, translation from the waiting state in FIG. 4A to the contact state (monochrome printing state) at the time of monochrome printing state illustrated in FIG. 4C will be described. The switching of the state is performed at a timing of the start of formation of a toner image on the photosensitive drum 1. In the waiting state in FIG. 4A, the contact-separation motor 90 is rotated reversely by a predetermined number of steps. Then, the cam gears 94*a*, 94*b*, 94*c*, and 94*d* and the cams 80*a*, 80*b*, 80*c*, and 80*d* rotate clockwise, respectively. However, when rotated reversely, only the cam 80*d* releases the pressing force on the side surface of the developing unit 4*d* firstly due to the shift of the rotated phase of the cams 80*a*, 80*b*, 80*c*, and 80*d*, and only the developing roller 24*d* comes into contact with the photosensitive drum 1*d*. The predetermined number of steps is set so as to stop the drive of the contact-separation motor 90 in this state, and only the developing roller 24*d* is kept in the contact state at the time of the monochrome printing illustrated in FIG. 4C.

The transfer from the monochrome printing state to the waiting state is achieved by rotating the contact-separation motor 90 forward by predetermined number of steps. Accordingly, the cam 80*d* presses the side surface of the developing roller 24*d* and hence the developing roller 24*d* is separated from the photosensitive drum 1*d*, and is returned back to the waiting state.

As described thus far, by controlling the direction of rotation of the contact-separation motor 90 (forward rotation, reverse rotation) and the amount of rotation, the contact and separation of the photosensitive drum 1 and the corresponding developing roller 24 may be controlled into the waiting state, the color printing state, and the monochrome printing state.

Description of Object of Example 1

Subsequently, the object of Example 1 will be described. Here a time period required from an input of print signal which instructs the image formation to the image forming apparatus 100 until an output of a first piece of the transfer material S with a toner image on the basis of the print signal transferred and fixed thereon is defined as a first printout time (hereinafter, referred to as FPOT). When the time period required for the FPOT is roughly divided into two periods, that is, a time period from the input of a print signal to the printer 100 until the start of the image formation, and a time period from the start of the image formation until the completion of the output of the transfer material S with the toner image transferred and fixed into a paper discharging tray. The former time period mainly includes a start-up time period of a polygon motor of the scanner unit 3, a heating time period of the fixing unit 14, and a time period required for the image forming station to be translated to the image formable state such as bringing the developing roller 24 into contact with the photosensitive drum 1. The latter includes a process speed (the rotation speed of the photosensitive drum 1 at the time of image formation) of the image forming apparatus 100 or a time period subject to the speed of conveyance of the transfer material S from the sheet supplying cassette 11 to the paper-discharge tray or the length of a conveyance path.

The object of Example 1 is to shorten the above-described time period required for the developing roller 24 to be translated from the waiting state to the color-printing state, thereby shortening the time period required for bringing the developing roller 24 into contact with the photosensitive drum 1, and the FPOT at the time of performing the color printing.

From the description given below, the object of Example 1 relating to the speed control of the contact-separation motor 90 will be described. However, before the description, development contact-separation control of the related art (speed control of the contact-separation motor 90) will be described with reference to FIG. 5 and FIG. 7. The contact-separation mechanism of developing roller of the related art is the same as the contact-separation mechanism of developing roller of Example 1, and hence the description will be omitted.

Control of Contact-Separation Mechanism of Developing Roller of Related Art

Figure 5:
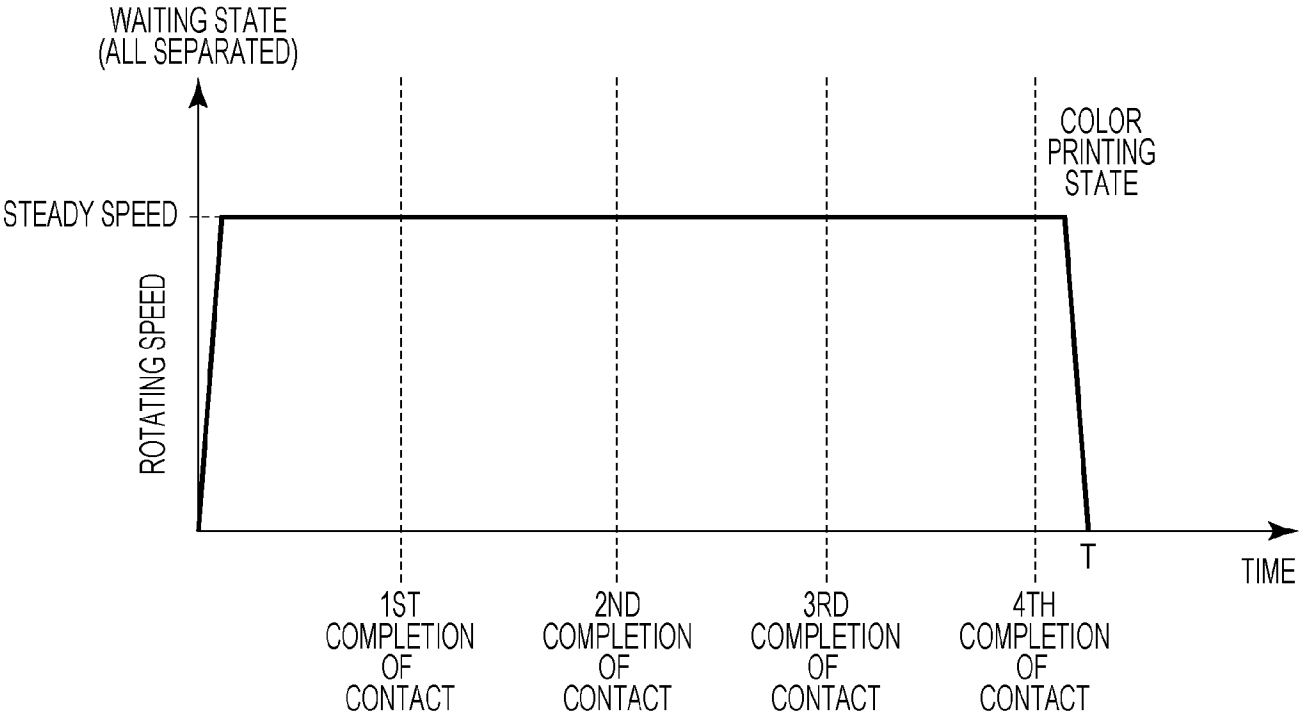
FIG. 5 is a graph illustrating a rotation speed of rotating of a contact-separation motor when the state is translated from a waiting state to a color printing state by speed control of a development contact-separation motor of the related art.

FIG. 5 is a graph illustrating a rotation speed of a contact-separation motor 90 when the state is translated from the waiting state to the color printing state by speed control of a development contact-separation motor 90 of the related art.

Figure 7:
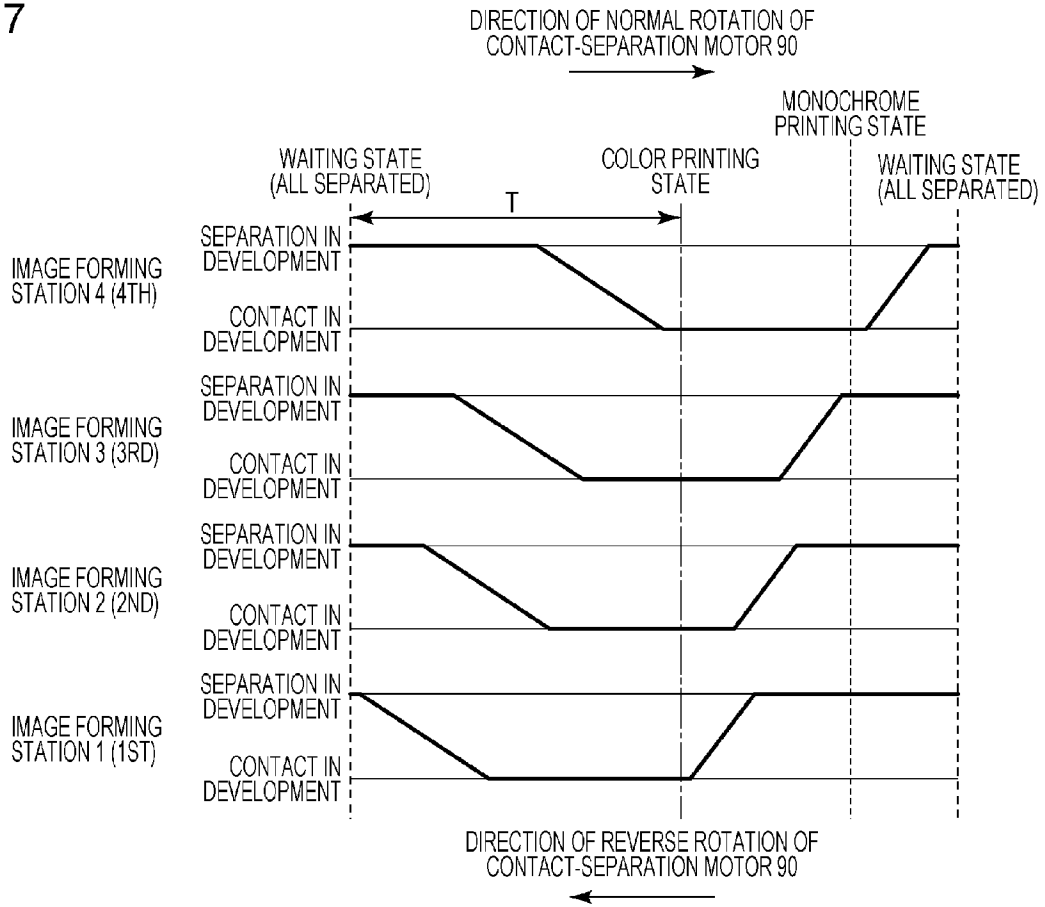
FIG. 7 is a drawing illustrating a relation between the rotation of cam gears (cams) rotated by the development contact-separation motor and contact and separation of the respective developing rollers in contact-separation control of the related art.

FIG. 7 is a drawing illustrating a relation between the rotation of cam gears 94*a* to 94*d* (cams 80*a* to 80*d*) rotated by the development contact-separation motor 90 and contact and separation of the respective developing rollers 24*a* to 24*d*. A lateral axis indicates time period required for making one turn, and when the contact-separation motor 90 is rotated forward (when the cam 80 rotates counterclockwise), the state is changed from the left to the right in the drawing. When the contact-separation motor 90 is rotated reversely (when the cams 80*a*, 80*b*, 80*c*, and 80*d* rotate clockwise), the state is changed from the right to the left in the drawing. When the cam 80 makes one turn, the state becomes the same as that before the turn, so that the waiting state on the left end of the drawing and the waiting state on the right end of the drawing indicate the same state. From the description below, a configuration including a pair of the developing roller 24 and the photosensitive drum 1 is defined as a image-forming station, and the image-forming station in which the image formation is performed by using yellow toner is defined as "image-forming station 1 (1st)". In the same manner, the image-forming station in which the image formation is performed by using magenta toner, the image-forming station in which the image formation is performed by using cyan toner, and the image-forming station in which the image formation is performed by using black toner are defined as the image-forming station 2 (2nd), the image-forming station 3 (3rd), and the image-forming station 4 (4th), respectively.

Returning back to the description of the development contact-separation control, when moving from the waiting state to the full-color state (color-printing state) as illustrated in FIG. 5, the contact-separation motor 90 rotates practically at a steady speed from the start of rotation (start of driving). As described above, since the cams 80*a* to 80*d* are provided so as to have rotated phases shifted in sequence as described above, the developing rollers 24*a*, 24*b*, 24*c*, and 24*d* move toward the corresponding photosensitive drums 1*a*, 1*b*, 1*c*, and 1*d* and come into contact therewith in the sequence of yellow (1st), magenta (2nd), cyan (3rd), and black (4th) as illustrated in FIG. 7. The contact-separation motor 90 stops rotation after the completion of contact of the last developing roller 24*d* to the photosensitive drum 1*d* by the control of the amount of rotation described above. Here, a time period required until the contact-separation motor 90 is rotated from the waiting state to bring the developing roller 24*d* into contact with the photosensitive drum 1*d* to achieve the color printing state is defined as T.

Control of Contact-Separation Mechanism of Developing Roller of Example 1

Figure 10:
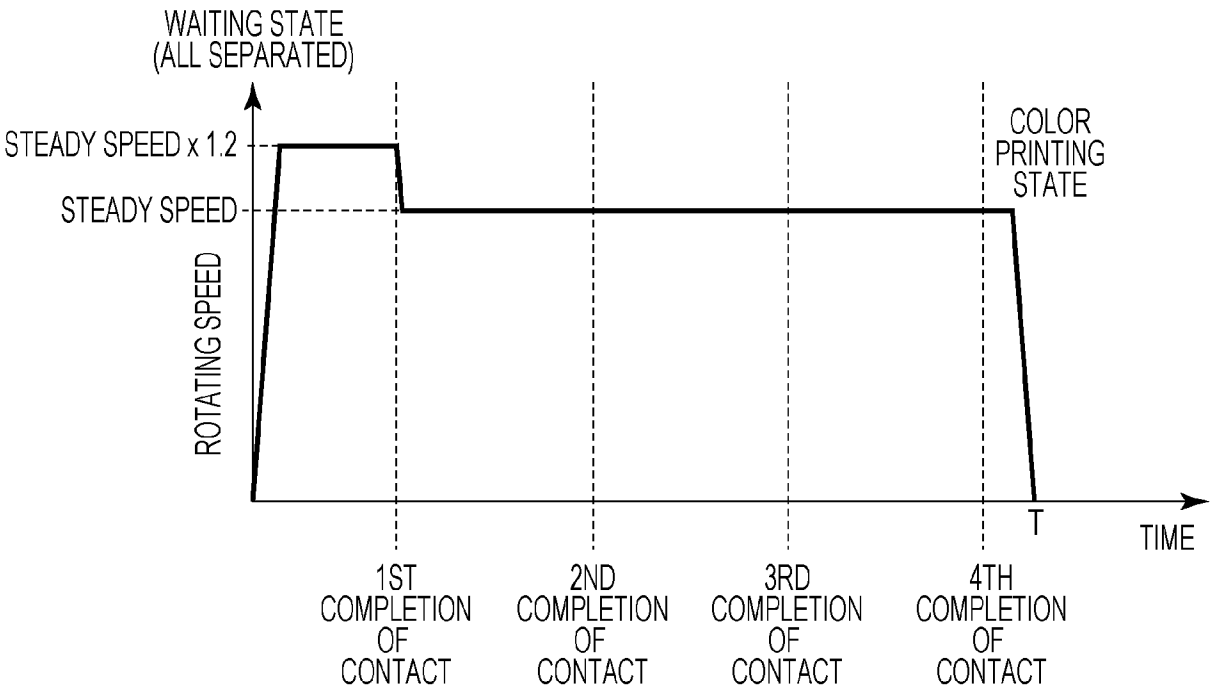
FIG. 10 is a graph illustrating a rotation speed of a contact-separation motor when the state is translated from the waiting state to the color printing state by speed control of a development contact-separation motor.
Figure 11:
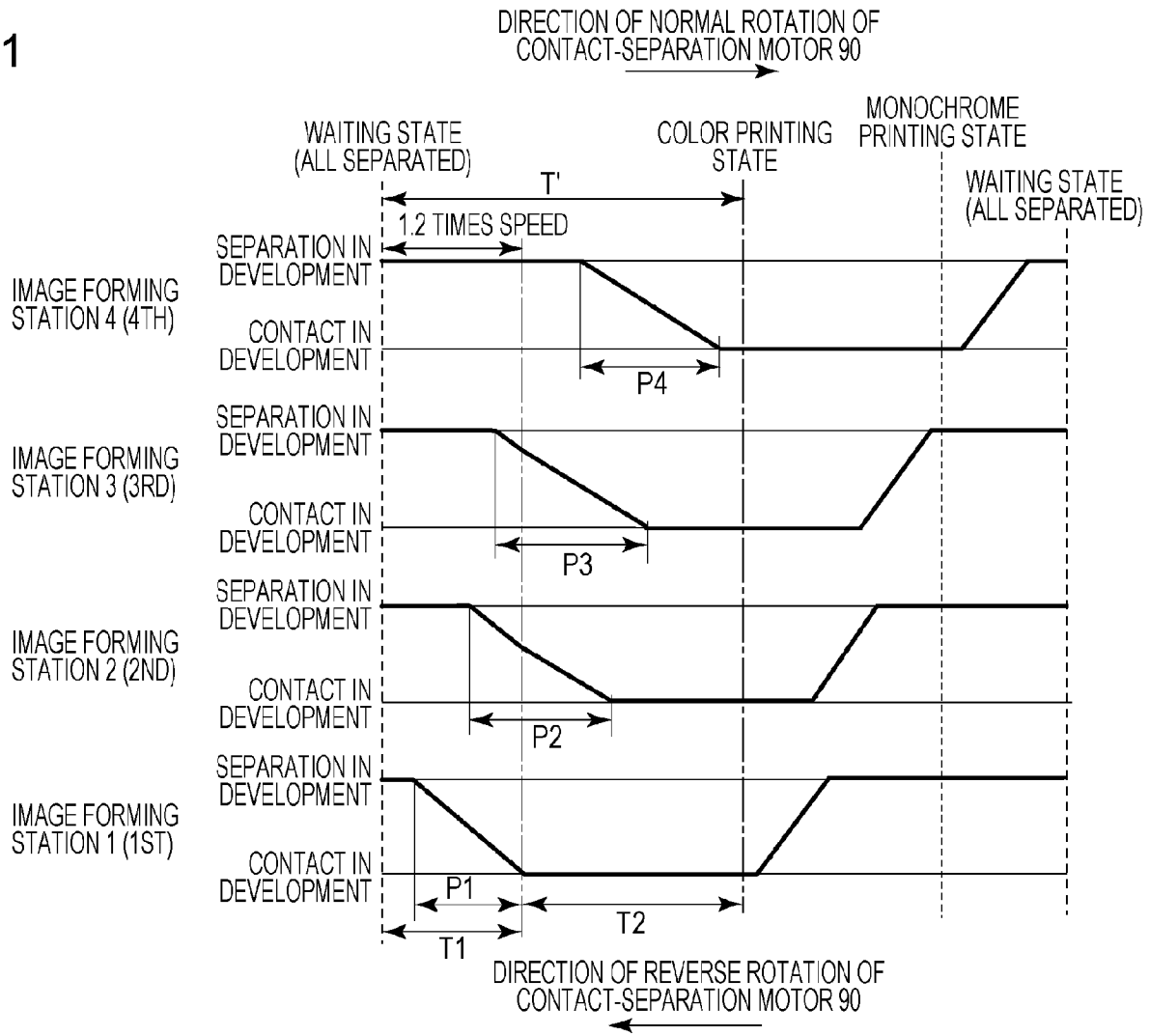
FIG. 11 is a drawing illustrating a relation between the rotation of cam gears (cams) rotated by the development contact-separation motor and contact and separation of the respective developing rollers in the development contact-separation control.

Subsequently, the development contact-separation control of Example 1 will be described. In Example 1, the time period until the developing roller 24*a*, which comes into contact with the photosensitive drum 1*a* firstly, is shortened. The configuration will be described in detail. FIG. 10 is a graph illustrating a rotation speed of a contact-separation motor 90 when the state is translated from the waiting state to the color printing state by speed control of the development contact-separation motor 90 of Example 1. FIG. 11 is a drawing illustrating a relation between the rotation of cam gears 94*a* to 94*d* (cams 80*a* to 80*d*) rotated by the development contact-separation motor 90 and contact and separation of the respective developing rollers 24*a* to 24*d* of Example 1. As illustrated in FIG. 10, during a time period from the start of rotation (start of driving) of the contact-separation motor 90 in the waiting state until the completion of contact of the developing roller 24*a* with periods of acceleration and deceleration excluded, the rotation speed (driving speed) of the contact-separation motor 90 is controlled to be always 1.2 times the normal speed. The normal speed is a speed in a period from the completion of the developing roller 24*a* in the image-forming station 1 until the developing roller 24*d* in the image-forming station 4 in which the contact is taken place at the end.

By controlling the contact-separation motor 90 in this manner, a time period T1 from the start of rotation of the contact-separation motor 90 upon reception of the print signal when in the waiting state until a completion of contact between the developing roller 24*a* and the photosensitive drum 1*a* in the image-forming station 1 to allow the start of formation of the toner image on the photosensitive drum 1*a* may be shortened in comparison with the related art. Accordingly, the timing of starting of the image formation in the image-forming station 1 may be moved up. A time period from the waiting state until the color printing state is achieved becomes time period T' which is also shorter than the control of the related art by an amount corresponding to the shortening of the time period T1. As is understood from the description given above, the time periods until the start of the formation of the toner images on the photosensitive drums 1*b*, 1*c*, and 1*d*may be shortened in comparison with that of the related art also in the image-forming stations 2, 3, and 4 which starts the image formation in sequence so as to match the timings of contact of developing roller 24 in the respective stations. Therefore, the timings of starting of the image formation in the image-forming stations may be moved up. Consequently, shortening of the FPOT is achieved.

When a period from a state in which the developing roller 24 is separated from the photosensitive drum 1 through the start of movement toward the corresponding photosensitive drum 1 until the completion of contact with the photosensitive drum 1 is referred to as an unfixed period, the unfixed period P1 is set to be shorter than the unfixed period P2, P3, and P4. The unfixed periods P2, P3, and P4 of the developing rollers 24*b*, 24*c*, and 24*d* have substantially the same length, and have substantially equal time period secured to the control of the related art, so that the developing rollers 24*b*, 24*c*, and 24*d* come into contact with the photosensitive drums 1*b*, 1*c*, and 1*d* at a speed equivalent to that of the related art. Therefore, impacts that the photosensitive drums 1*b*, 1*c*, and 1*d* are subject to by the contact of the developing rollers 24*b*, 24*c*, and 24*d* are not magnified, the distortion of the image is suppressed and hence the quality of the image is desirably maintained, and the start timing of the image formation in each of the respective image-forming station may be moved up by an amount corresponding to the amount of shortening of the unfixed period P1.

The unfixed period P1 of the developing roller 24*a* is shorter than the unfixed periods P2 to P4 of the developing rollers 24*b*, 24*c*, and 24*d* and the unfixed period of the developing roller 24*a* of the related art. However, the timing of contact of the developing roller 24*a* with the first photosensitive drum 1*a* comes before the start of the image formation on the image-forming stations (no toner image is formed on any of the photosensitive drums 1*a*, 1*b*, 1*c*, and 1*d*), the impact caused by the contact does not affect the image formation, and hence no image distortion occurs, and the image quality is desirably maintained.

In this manner, in order to shorten the unfixed period P1 to be shorter than the unfixed period P2, P3, and P4, a period in which the contact-separation motor 90 is rotated at a speed faster than the normal speed may be provided in a period in which only the developing roller 24*a* except for the developing rollers 24*b*, 24*c*, and 24*d* moves toward the contact position out of a period from the start of the contact-separation motor 90 in the waiting state until the completion of the contact of the developing roller 24*a*.

As described thus far, in Example 1, control is performed so that the period in which the contact-separation motor 90 is rotated at a speed faster than the normal speed is included in a period in which only the developing roller 24*a* moves toward the contact position out of the period from the start of the contact-separation motor 90 in the waiting state until the completion of the contact of the developing roller 24*a*. In other words, control to make an average speed of the contact-separation motor 90 in the period in which only the developing roller 24*a* moves toward the contact position faster than an average speed during the period from the completion of contact of the developing roller 24*c* until the completion of contact of the developing roller 24*d*. The period in which only the developing roller 24*a* moves toward the contact position out of the period from the start of the contact-separation motor 90 in the waiting state until the completion of the contact of the developing roller 24*a* corresponds to a period from the start of movement of the developing roller 24*a* toward the developing position thereof until the start of movement of the developing member 24*b* to the developing position thereof. Accordingly, the unfixed period P1 of the developing roller 24*a* may be set to be shorter than the unfixed period P2 to P4 of the developing rollers 24*b* to 24*d*. Therefore, the periods from the start of the rotation of the contact-separation motor 90 upon the reception of the print signal in the waiting state until the completion of contact of the developing rollers 24*a*, 24*b*, 24*c*, and 24*d* with the photosensitive drums 1*a*, 1*b*, 1*c*, and 1*d* in each of the image forming stations 1 to 4 may be shortened while suppressing the distortion of the image and in addition, the FPOT may be shortened.

In addition, a configuration in which the cam 80*a* and the cams 80*b* to 80*d* are not driven by the common contact-separation motor 90 and are driven by different contact-separation motors is also applicable. In this case, control such that the cam 80*a* is rotated by a first contact-separation motor, the cams 80*b* to 80*d* are rotated by a second contact-separation motor, and the rotation speed of the cam 80*a* may be increased to be faster than the rotation speeds of the cams 80*b* to 80*d* at the time of moving the developing rollers 24*b* to 24*d* from a state of being at the waiting position to the completion of contact during a period from a state in which the developing roller 24*a* is at the waiting position through the rotation of the cam 80*a* to the completion of contact of the developing roller 24*a* is also applicable. In this configuration as well, the unfixed period P1 may be set to be shorter than the unfixed period P2, P3, and P4, and the same effects and advantages may be achieved.

EXAMPLE 2

Subsequently, Example 2 will be described. The contact-separation mechanism of developing roller except for the configuration of the image forming apparatus and the configuration of the cam 80*a* is the same as that in Example 1, and hence the same reference signs are assigned and description will be omitted. In Example 1, a period from the start of the rotation of the contact-separation motor 90 upon reception of the printing signal when in the weighting state until the image formation is enabled is shortened by controlling the speed of the contact-separation motor 90. In contrast, in Example 2, the period until the image formation is enabled is shortened by changing a profile (the shape of the cam surface) of the cam 80*a*.

Figure 8:
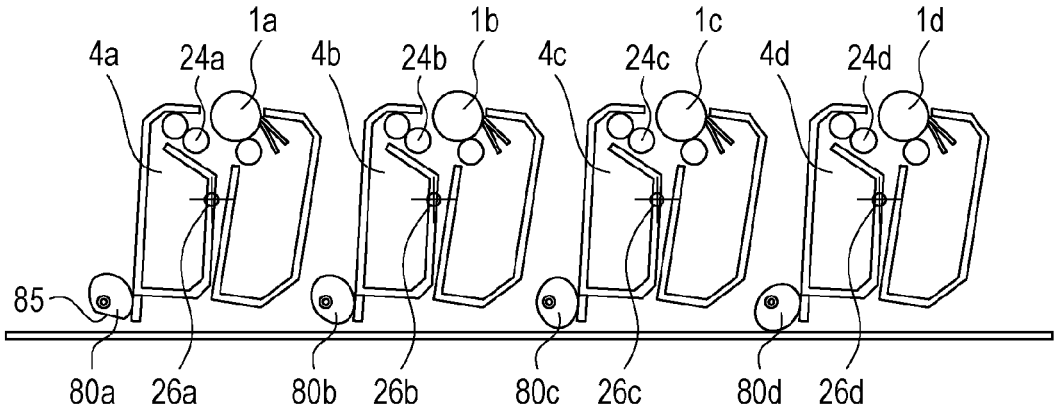
FIG. 8 is a schematic cross sectional view for explaining contact and separation of the respective developing rollers by four cams of the contact-separation mechanism of developing roller.
Figure 9:
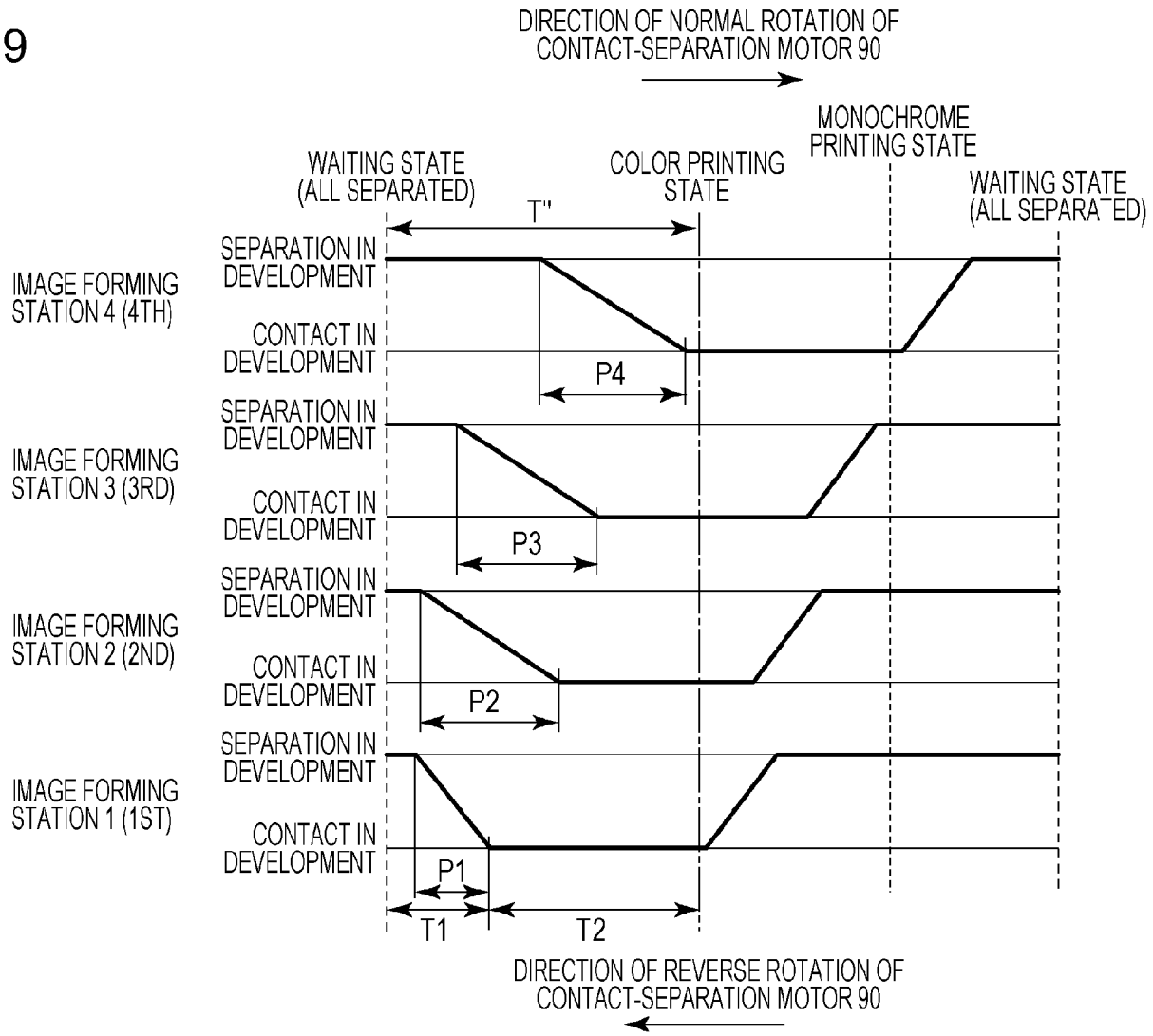
FIG. 9 is a drawing illustrating a relation between the rotation of cam gears rotated by the development contact-separation motor and contact and separation of the respective developing rollers in the development contact-separation control.

FIG. 8 is a schematic cross sectional view for explaining contact and separation of the respective developing rollers 24*a* to 24*d* by four cams 80*a* to 80*d* of the contact-separation mechanism of developing roller. FIG. 9 is a drawing illustrating a relation between the rotation of cam gears 94*a* to 94*d* (cams 80*a* to 80*d*) rotated by the development contact-separation motor 90 and contact and separation of the respective developing rollers 24*a* to 24*d* of Example 2.

As illustrated in FIG. 8, a profile of the cam 80*a* of the image-forming station 1 is different from profiles of the cams 80*b*, 80*c*, and 80*d* of other image forming stations, 3, and 4. Specifically, a peripheral surface of the cam 80*a* which comes into contact with the developing unit 4*a* during the unfixed period P1 from the start of the movement of the developing roller 24*a* toward the photosensitive drum 1*a* until the completion of contact is formed with a bevel 85 at an angle to cause the developing unit 4*a* to move abruptly. With this profile, the amount of rotation (rotation angle) of the cam 80*a* corresponding to the unfixed period P1 is reduced. In other words, the amount of rotation of the cam 80*a* required for moving the corresponding developing roller 24 from the separated position to the contact position is smaller than that of the cam 80*a* of the related art or of Example 1, or that of the other cams 80*b* to 80*d*. In other words, the speed of the developing roller 24*a* moving toward the photosensitive drum 1 is set to be faster than the remaining cams 80*b* to 80*d*. Therefore, the time period from the start of the movement of the developing roller 24*a* toward the photosensitive drum 1*a* until the completion of contact may be shortened. In addition, the speed of the developing roller 24*a* moving toward the photosensitive drum la is faster than those in the other image-forming stations 2, 3, and 4. In other words, the unfixed period P1 of the developing roller 24*a* may be set to be shorter than the unfixed periods P2, P3, and P4 of the developing rollers 24*b*, 24*c*, and 24*d*.

Therefore, as illustrated in FIG. 9, the unfixed period P1 between the separated state and the contact state of the developing roller 24 may be shortened. Consequently, the time period T1 from the start of rotation of the contact-separation motor 90 upon reception of the print signal when in the waiting state until a completion of contact between the first developing roller 24*a* and the photosensitive drum 1*a* in the image forming station 1 to allow the start of formation of the toner image on the photosensitive drum 1*a* may be shortened in comparison with the related art. Accordingly, the timing of the start of the image formation in the image-forming station 1 may be moved up.

In Embodiment 2, the rotated phases of the cams 80*b* to 80*d* in the waiting state is set to be advanced counterclockwise in comparison with the configuration in the related art and Example 1 so that the movement of the developing rollers 24*b* to 24*d* toward the corresponding contact positions may be started earlier by an amount corresponding to the reduction of the amount of rotation until the developing roller 24*a* moves from the waiting state of the cam 80*a* until the completion of the contact with the photosensitive drum 1*a*. However, the amount of advancing the rotated phase is an amount that allows the state in which the developing rollers 24*b* to 24*d* are reliably separated from the photosensitive drums 1*b* to 1*d*to be maintained in the waiting state.

In this manner, the amounts of rotation of the cams 80*b* to 80*d* until the completion of contact of the developing rollers 24*b* to 24*d* with the photosensitive drums 1*b* to 1*d* are set to be smaller than the configuration of the related art and Example 1 by advancing the rotated phases of the cams 80*b* to 80*d* in the waiting state counterclockwise. Accordingly, the speed of the developing rollers 24*b*, 24*c*, and 24*d* come into contact with the photosensitive drums 1*b*, 1*c*, and 1*d* may be set to be equal to those of the related art or Example 1 while shortening the time periods until the completion of contact of the developing rollers 24*b*, 24*c*, and 24*d* with the photosensitive drums 1*b*, 1*c*, and 1*d* by an amount of shortening of the time period until the completion of the contact of the developing roller 24*a* with the first photosensitive drum la. Accordingly, the time period from the waiting state until the color printing state is achieved becomes time period T" which is also shorter than the control of the related art by an amount corresponding to the shortening of the time period T1. Therefore, the timings of starting of the image formation in the image-forming stations may be moved up. Consequently, shortening of the FPOT is achieved.

In rotated phases of the cams 80*b* to 80*d* in the waiting state are advanced for shortening the time periods until the completion of contact of the developing rollers 24*b*, 24*c*, and 24*d* with the photosensitive drums 1*b*, 1*c*, and 1*d* by an amount of shortening of the time period until the completion of the contact of the developing roller 24*a* with the photosensitive drum 1*a*. However, this discloser is not limited thereto. In other words, the time period until the developing rollers 24*b* to 24*d* start moving to come into contact with the photosensitive drums 1*b* to 1*d* may be shortened by setting the portions of the cams 80*b*, 80*c*, and 80*d* corresponding to the unfixed periods P2 to P4 to be the same as those of the related art and Example 1, while changing the profile of the portion corresponding to a period before the unfixed period P2, P3, and P4.

In addition, the unfixed period P1 may be set to be shorter than the unfixed period P2, P3, and P4. The unfixed periods P2, P3, and P4 of the developing rollers 24*b*, 24*c*, and 24*d* have the same length, and have the equal time period secured to the control of the related art, so that the developing rollers 24*b*, 24*c*, and 24*d* come into contact with the photosensitive drums 1*b*, 1*c*, and 1*d* at a speed equivalent to that of the related art. Therefore, impacts that the photosensitive drums 1*b*, 1*c*, and 1*d* are subject to by the contact of the developing rollers 24*b*, 24*c*, and 24*d* are not magnified, the distortion of the image is suppressed and hence the quality of the image is desirably maintained, and in addition, the start timing of the image formation in each of the respective image-forming station may be moved up by an amount corresponding to the amount of shortening of the unfixed period P1.

The unfixed period P1 of the developing roller 24*a* is shorter than the unfixed period P2, P3, and P4 of the developing rollers 24*b*, 24*c*, and 24*d* and the unfixed period of the developing roller 24*a*. However, the timing of contact of the developing roller 24*a* with the photosensitive drum 1*a* comes before the start of the image formation on the image-forming stations (no toner image is formed on any of the photosensitive drums 1*a*, 1*b*, 1*c*, and 1*d*), the impact caused by the contact does not affect the image formation, and hence no image distortion occurs, the image quality is desirably maintained.

As described thus far, in Example 2, the profile of the cam 80*a* is set so that the time period from the start of movement of the developing roller 24*a* toward the photosensitive drum 1*a* until the completion of the contact (unfixed period P1) becomes shorter than the time periods (the unfixed periods P2, P3, and P4) from the start of movement of the developing rollers 24*b*, 24*c*, and 24*d* toward the photosensitive drums 1*b*, 1*c*, and 1*d*. Therefore, the periods from the start of the rotation of the contact-separation motor 90 in the waiting state until the completion of contact of the developing roller 24*a* may be shortened while suppressing the distortion of the image. Accordingly, the periods from the start of the rotation of the contact-separation motor 90 upon the reception of the print signal in the waiting state until the completion of contact of the developing rollers 24*a*, 24*b*, 24*c*, and 24*d* with the photosensitive drums 1*a*, 1*b*, 1*c*, and 1*d* in each of the image forming stations 1, 2, 3, and 4 may be shortened while suppressing the distortion of the image and in addition, the FPOT may be shortened.

The contact-separation motor 90 may be controlled so that The period in which only the developing roller 24*a* moves toward the contact position out of the period from the start of the contact-separation motor 90 in the waiting state until the completion of the contact of the developing roller 24*a* as in Example 1 in addition to the setting of profile of the cam 80*a* so that the amount of rotation required for moving the corresponding developing roller 24*a* from the separated position to the contact position is reduced. In this configuration, the unfixed period P1 may be shortened in comparison with the unfixed period P2 to P4 and the FPOT may be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-272621 filed Dec. 13, 2012 and No. 2013-251040 filed Dec. 4, 2013, which are hereby incorporated by reference herein in their entirety.

What is claimed is:

1. An image forming apparatus comprising:

first and second photosensitive members; and first and second developing members provided corresponding to the first and second photosensitive members and configured to be movable between developing position where toner is adhered to the corresponding photosensitive members and retracted position retracted from the developing position respectively, wherein the first and second developing members are moved to the developing position from the retracted position respectively in the order of the first developing member and the second developing member, and image forming is started by adhering the toner to the first photosensitive member and the second photosensitive member in this order, and wherein a period in which the first developing member moves from the retracted position to the developing position is shorter than a period in which the second developing member moves from the retracted position to the developing position.

2. The image forming apparatus according to claim 1, further comprising:

a first cam member having a first cam surface configured to restrict a position of the first developing member with respect to the first photosensitive member; and a second cam member having a second cam surface configured to restrict a position of the second developing member with respect to the second photosensitive member, wherein the shapes of the first cam surface and the second cam surface are different.

3. The image forming apparatus according to claim 2, wherein an amount of rotation of the first cam member required for moving the first developing member from the retracted position to the developing position is smaller than an amount of rotation of the second cam member required for moving the second developing member from the retracted position to the developing position.

4. The image forming apparatus according to claim 2, wherein the first cam member and the second cam member are rotated by a common drive source.

5. The image forming apparatus according to claim 2, further comprising:

first and second developing units with which the first and second cam members contact respectively, wherein the first and second developing member are rollers respectively supported rotatably by the first and second developing units.

6. The image forming apparatus according to claim 1, further comprising:

a drive source; and a moving member configured to be driven by the drive source and move the first and second developing members from the retracted position to the developing position respectively, wherein during a period in which the drive source drives the moving member to move the first and second developing members respectively from the retracted position to the developing position, a driving speed at which the drive source drives the moving member during a period from the start of movement of the first developing member toward the developing position until the second developing member starts movement toward the developing position is faster than a driving speed at which the drive source drives the moving member during a period from completion of movement of the first developing member to the developing position to completion of movement of the second developing member to the developing position.

7. The image forming apparatus according to claim 6, wherein the moving member is a cam member configured to be rotated by being driven by the drive source, and the cam member includes a first cam member having a first cam surface configured to restrict a position of the first developing member with respect to the first photosensitive member and a second cam member having a second cam surface configured to restrict a position of the second developing member with respect to the second photosensitive member.

8. The image forming apparatus according to claim 7, wherein the shapes of the first cam surface and the second cam surface are the same.

9. The image forming apparatus according to claim 7, wherein the shapes of the first cam surface and the second cam surface are different, and an amount of rotation of the first cam member required for moving the first developing member from the retracted position to the developing position is smaller than an amount of rotation of the second cam member required for moving the second developing member from the retracted position to the developing position.

10. The image forming apparatus according to claim 7, further comprising:

first and second developing units to which the first and second cam members contact respectively, wherein the first and second developing members are rollers respectively supported rotatably by the first and second developing units.

* * * * *